US012780469B2

(12) United States Patent
Chappell et al.

(10) Patent No.: US 12,780,469 B2
(45) Date of Patent: Nov. 3, 2026

(54) ORAL POUCH PRODUCT HAVING SOFT EDGE AND METHOD OF MAKING

(71) Applicant: Philip Morris USA Inc., Richmond, VA (US)

(72) Inventors: Fernando L. Chappell, Colonial Heights, VA (US); Danielle R. Crawford, Chester, VA (US)

(73) Assignee: Philip Morris USA Inc., Richmond, VA (US)

( * ) Notice: Subject to any disclaimer, the term of this patent is extended or adjusted under 35 U.S.C. 154(b) by 0 days.

(21) Appl. No.: 18/907,909

(22) Filed: Oct. 7, 2024

(65) Prior Publication Data

US 2025/0026517 A1 Jan. 23, 2025

Related U.S. Application Data

(60) Continuation of application No. 18/064,477, filed on Dec. 12, 2022, now Pat. No. 12,116,154, which is a continuation of application No. 16/851,797, filed on Apr. 17, 2020, now Pat. No. 11,542,049, which is a continuation of application No. 15/869,193, filed on Jan. 12, 2018, now Pat. No. 10,640,246, which is a (Continued)

(51) Int. Cl.

| | |
|---|---|
| ***B65B 29/02*** | (2006.01) |
| ***A24F 23/02*** | (2006.01) |
| ***B65B 7/02*** | (2006.01) |
| ***B65B 51/02*** | (2006.01) |
| ***B65B 51/10*** | (2006.01) |
| ***B65B 61/00*** | (2006.01) |
| ***B65D 75/40*** | (2006.01) |

(52) U.S. Cl.

CPC ..... *B65B 29/02* (2013.01); *A24F 23/02* (2013.01); *B65B 7/02* (2013.01); *B65B 51/02* (2013.01); *B65B 51/10* (2013.01); *B65B 61/005* (2013.01); *B65D 75/40* (2013.01); *Y10T 428/1334* (2015.01)

(58) Field of Classification Search

None

See application file for complete search history.

(56) References Cited

U.S. PATENT DOCUMENTS

| | | | |
|---|---|---|---|
| 307,537 | A | 11/1884 | Foulks |
| 1,234,279 | A | 7/1917 | Buchanan |

(Continued)

FOREIGN PATENT DOCUMENTS

| | | | |
|---|---|---|---|
| EP | 0145499 | A2 | 6/1985 |
| EP | 0212234 | A2 | 3/1987 |

(Continued)

OTHER PUBLICATIONS

International Preliminary Report on Patentability dated Jan. 19, 2010 for PCT/IB2008/002682.

(Continued)

*Primary Examiner* — Phu H Nguyen

(74) *Attorney, Agent, or Firm* — HARNESS, DICKEY & PIERCE, P.L.C.

(57) ABSTRACT

An oral pouch product having a soft edge includes an inner filling material enclosed inwardly of at least one seam between opposed layers of porous pouch wrapper. The at least one seam is separated from the periphery of the porous pouch wrapper by an unbonded area of the opposed layers so as to form a soft edge of the pouch wrapper.

19 Claims, 2 Drawing Sheets

Related U.S. Application Data continuation of application No. 14/594,664, filed on Jan. 12, 2015, now Pat. No. 9,889,956, which is a division of application No. 12/219,113, filed on Jul. 16, 2008, now Pat. No. 8,950,408.

(60) Provisional application No. 60/929,876, filed on Jul. 16, 2007.

(56) References Cited

U.S. PATENT DOCUMENTS

| | | | |
|---|---|---|---|
| 1,376,586 | A | 5/1921 | Schwartz |
| 1,992,152 | A | 2/1935 | Yeates |
| 2,306,400 | A | 12/1942 | Menzel |
| 2,313,696 | A | 3/1943 | Yates |
| 2,318,101 | A | 5/1943 | Rose |
| 2,330,361 | A | 9/1943 | Howard |
| 2,528,778 | A | 11/1950 | Piazze |
| 3,067,068 | A | 12/1962 | Finberg |
| 3,162,199 | A | 12/1964 | Moll, Jr. |
| 3,174,889 | A | 3/1965 | Anderson et al. |
| 3,188,265 | A | 6/1965 | Charbonneau et al. |
| 3,369,551 | A | 2/1968 | Carroll |
| 3,415,286 | A | 12/1968 | Arnold et al. |
| 3,600,807 | A | 8/1971 | Sipos |
| 3,607,299 | A | 9/1971 | Bolt |
| 3,692,536 | A | 9/1972 | Esco |
| 3,757,798 | A | 9/1973 | Lambert |
| 3,846,569 | A | 11/1974 | Kaplan |
| 3,932,192 | A | 1/1976 | Nakashio et al. |
| 4,218,286 | A | 8/1980 | Jones et al. |
| 4,347,857 | A | 9/1982 | Boden |
| 4,545,392 | A | 10/1985 | Sensabaugh, Jr. et al. |
| 4,565,702 | A | 1/1986 | Morley et al. |
| 4,607,479 | A | 8/1986 | Linden |
| 4,624,269 | A | 11/1986 | Story et al. |
| 4,660,577 | A | 4/1987 | Sensabaugh et al. |
| 4,703,765 | A | 11/1987 | Paules et al. |
| 4,797,287 | A | 1/1989 | Pich et al. |
| 4,880,697 | A | 11/1989 | Caldwell et al. |
| 4,892,483 | A | 1/1990 | Douglas, Jr. |
| 4,907,605 | A | 3/1990 | Ray et al. |
| 4,917,161 | A | 4/1990 | Townend |
| 5,127,208 | A | 7/1992 | Custer et al. |
| 5,167,244 | A | 12/1992 | Kjerstad |
| 5,174,088 | A | 12/1992 | Focke et al. |
| 5,186,185 | A | 2/1993 | Mashiko et al. |
| 5,211,985 | A | 5/1993 | Shirley, Jr. et al. |
| 5,240,016 | A | 8/1993 | Nichols et al. |
| 5,263,999 | A | 11/1993 | Baldwin et al. |
| 5,346,734 | A | 9/1994 | Wydick, Jr. |
| 5,372,149 | A | 12/1994 | Roth et al. |
| 5,387,416 | A | 2/1995 | White et al. |
| 5,525,351 | A | 6/1996 | Dam |
| 5,549,906 | A | 8/1996 | Santus |
| 5,601,716 | A | 2/1997 | Heinrich et al. |
| 5,726,161 | A | 3/1998 | Whistler |
| 5,773,062 | A | 6/1998 | Cirigliano et al. |
| 5,806,408 | A | 9/1998 | DeBacker et al. |
| 5,829,453 | A | 11/1998 | White et al. |
| 5,921,955 | A | 7/1999 | Mazer et al. |
| 5,927,052 | A | 7/1999 | Nippes et al. |
| 5,997,691 | A | 12/1999 | Gautam et al. |
| 6,021,624 | A | 2/2000 | Richison et al. |
| 6,135,120 | A | 10/2000 | Lofman et al. |
| 6,143,316 | A | 11/2000 | Hayden et al. |
| 6,146,655 | A | 11/2000 | Ruben |
| 6,162,516 | A | 12/2000 | Derr |
| 6,280,761 | B1 | 8/2001 | Santus |
| 6,287,612 | B1 | 9/2001 | Mandava et al. |
| 6,325,859 | B1 | 12/2001 | De Roos et al. |
| 6,383,475 | B1 | 5/2002 | Meyers et al. |
| 6,414,033 | B1 | 7/2002 | Sceusa |
| 6,444,253 | B1 | 9/2002 | Conklin et al. |
| 6,455,068 | B1 | 9/2002 | Licari |
| D489,606 | S | 5/2004 | Lofman |
| 6,871,473 | B1 | 3/2005 | Dutt et al. |
| 6,878,695 | B2 | 4/2005 | Woo et al. |
| 6,895,974 | B2 | 5/2005 | Peele |
| 6,942,848 | B2 | 9/2005 | Nelson et al. |
| 6,958,429 | B2 | 10/2005 | Bruhn et al. |
| 6,982,093 | B2 | 1/2006 | Licari |
| 6,984,376 | B2 | 1/2006 | Stephenson et al. |
| 7,030,092 | B1 | 4/2006 | Levine |
| 7,032,601 | B2 | 4/2006 | Atchley et al. |
| 7,090,858 | B2 | 8/2006 | Jayaraman |
| 7,186,701 | B2 | 3/2007 | Kubota et al. |
| D568,576 | S | 5/2008 | Neidle et al. |
| D585,626 | S | 2/2009 | Chappell, Sr. et al. |
| 7,584,843 | B2 | 9/2009 | Kutsch et al. |
| 8,067,046 | B2 | 11/2011 | Schleef et al. |
| 8,124,147 | B2 | 2/2012 | Cheng et al. |
| 8,268,370 | B2 | 9/2012 | Miser et al. |
| 8,424,541 | B2 | 4/2013 | Crawford et al. |
| 8,747,562 | B2 | 6/2014 | Mishra et al. |
| 8,950,408 | B2 | 2/2015 | Chappell, Sr. et al. |
| 2002/0012689 | A1 | 1/2002 | Stillman |
| 2002/0170567 | A1 | 11/2002 | Rizzotto et al. |
| 2003/0070687 | A1 | 4/2003 | Atchley et al. |
| 2003/0109492 | A1 | 6/2003 | Loftsson |
| 2003/0224090 | A1 | 12/2003 | Pearce et al. |
| 2004/0015756 | A1 | 1/2004 | Chiu |
| 2004/0018293 | A1 | 1/2004 | Popplewell et al. |
| 2004/0037879 | A1 | 2/2004 | Adusumilli et al. |
| 2004/0118421 | A1 | 6/2004 | Hodin et al. |
| 2004/0123873 | A1 | 7/2004 | Calandro et al. |
| 2004/0145261 | A1 | 7/2004 | Ganter et al. |
| 2004/0191322 | A1 | 9/2004 | Hansson |
| 2004/0191366 | A1 | 9/2004 | Mangos et al. |
| 2004/0202698 | A1 | 10/2004 | Ramji et al. |
| 2004/0234479 | A1 | 11/2004 | Schleifenbaum et al. |
| 2004/0247649 | A1 | 12/2004 | Pearce et al. |
| 2004/0247744 | A1 | 12/2004 | Pearce et al. |
| 2004/0247746 | A1 | 12/2004 | Pearce et al. |
| 2005/0000531 | A1 | 1/2005 | Shi |
| 2005/0003048 | A1 | 1/2005 | Pearce et al. |
| 2005/0034738 | A1 | 2/2005 | Whalen |
| 2005/0061339 | A1 | 3/2005 | Hansson et al. |
| 2005/0100640 | A1 | 5/2005 | Pearce |
| 2005/0172976 | A1 | 8/2005 | Newman et al. |
| 2005/0178398 | A1 | 8/2005 | Breslin et al. |
| 2005/0210615 | A1 | 9/2005 | Shastry et al. |
| 2005/0241656 | A1 | 11/2005 | Kennison |
| 2005/0244521 | A1 | 11/2005 | Strickland et al. |
| 2005/0287249 | A1 | 12/2005 | Shukla et al. |
| 2006/0039973 | A1 | 2/2006 | Aldritt et al. |
| 2006/0073190 | A1 | 4/2006 | Carroll et al. |
| 2006/0118589 | A1 | 6/2006 | Arnarp et al. |
| 2006/0144412 | A1 | 7/2006 | Mishra et al. |
| 2006/0174901 | A1 | 8/2006 | Karles et al. |
| 2006/0191548 | A1 | 8/2006 | Strickland et al. |
| 2006/0204598 | A1 | 9/2006 | Thompson |
| 2006/0228431 | A1 | 10/2006 | Eben et al. |
| 2006/0275344 | A1 | 12/2006 | Mody et al. |
| 2007/0000505 | A1 | 1/2007 | Zhuang et al. |
| 2007/0012328 | A1 | 1/2007 | Winterson et al. |
| 2007/0048431 | A1 | 3/2007 | Budwig et al. |
| 2007/0062549 | A1 | 3/2007 | Holton et al. |
| 2007/0077307 | A1 | 4/2007 | Rosenberg et al. |
| 2007/0095356 | A1 | 5/2007 | Winterson et al. |
| 2007/0107747 | A1 | 5/2007 | Hill et al. |
| 2007/0122526 | A1 | 5/2007 | Sweeney et al. |
| 2007/0186941 | A1 | 8/2007 | Holton et al. |
| 2007/0186942 | A1 | 8/2007 | Strickland et al. |
| 2007/0186943 | A1 | 8/2007 | Strickland et al. |
| 2007/0186944 | A1 | 8/2007 | Strickland et al. |
| 2007/0190157 | A1 | 8/2007 | Sanghvi et al. |
| 2007/0207239 | A1 | 9/2007 | Neidle et al. |
| 2007/0261707 | A1 | 11/2007 | Winterson et al. |
| 2007/0267033 | A1 | 11/2007 | Mishra et al. |
| 2007/0298061 | A1 | 12/2007 | Boghani et al. |
| 2008/0014303 | A1 | 1/2008 | Jacops et al. |
| 2008/0029110 | A1 | 2/2008 | Dube et al. |
| 2008/0029116 | A1 | 2/2008 | Robinson et al. |

(56) References Cited

U.S. PATENT DOCUMENTS

| | | | |
|---|---|---|---|
| 2008/0029117 | A1 | 2/2008 | Mua et al. |
| 2008/0081071 | A1 | 4/2008 | Sanghvi et al. |
| 2008/0166395 | A1 | 7/2008 | Roush |
| 2008/0173317 | A1 | 7/2008 | Robinson et al. |
| 2008/0196730 | A1 | 8/2008 | Engstrom et al. |
| 2008/0202536 | A1 | 8/2008 | Torrence et al. |
| 2008/0302682 | A1 | 12/2008 | Engstrom et al. |
| 2008/0308115 | A1 | 12/2008 | Zimmermann |
| 2008/0317911 | A1 | 12/2008 | Schleef et al. |
| 2009/0004329 | A1 | 1/2009 | Gedevanishvili et al. |
| 2009/0022856 | A1 | 1/2009 | Cheng et al. |
| 2009/0022917 | A1 | 1/2009 | Gedevanishvili et al. |
| 2009/0025741 | A1 | 1/2009 | Crawford et al. |
| 2009/0035414 | A1 | 2/2009 | Cheng et al. |
| 2009/0126746 | A1 | 5/2009 | Strickland et al. |
| 2010/0218779 | A1 | 9/2010 | Zhuang et al. |
| 2010/0300464 | A1 | 12/2010 | Gee et al. |
| 2010/0300465 | A1 | 12/2010 | Zimmermann |

FOREIGN PATENT DOCUMENTS

| | | | |
|---|---|---|---|
| EP | 0352107 | A2 | 1/1990 |
| EP | 0422898 | A1 | 4/1991 |
| EP | 0483500 | A1 | 5/1992 |
| EP | 0599425 | A1 | 6/1994 |
| EP | 1010639 | A1 | 6/2000 |
| EP | 1118274 | A2 | 7/2001 |
| GB | 725764 | A | 3/1955 |
| GB | 924052 | A | 4/1963 |
| GB | 1139684 | A | 1/1969 |
| GB | 1350740 | A | 4/1974 |
| GB | 2074838 | A | 11/1981 |
| JP | H03240665 | A | 10/1991 |
| WO | 9425356 | A1 | 11/1994 |
| WO | 9745336 | A1 | 12/1997 |
| WO | 9940799 | A1 | 8/1999 |
| WO | 0057713 | A1 | 10/2000 |
| WO | 0170591 | A1 | 9/2001 |
| WO | 02080707 | A1 | 10/2002 |
| WO | 03030881 | A1 | 4/2003 |
| WO | 03053175 | A2 | 7/2003 |
| WO | 04/09445 | A2 | 1/2004 |
| WO | 2004052335 | A1 | 6/2004 |
| WO | 2004056219 | A1 | 7/2004 |
| WO | 2004058217 | A2 | 7/2004 |
| WO | 2004064811 | A1 | 8/2004 |
| WO | 2004066986 | A1 | 8/2004 |
| WO | 2004/095959 | A1 | 11/2004 |
| WO | 2005027815 | A1 | 3/2005 |
| WO | 05/046363 | A2 | 5/2005 |
| WO | 2005077232 | A2 | 8/2005 |
| WO | 2005084446 | A1 | 9/2005 |
| WO | 06/04480 | A1 | 1/2006 |
| WO | 2006039487 | A2 | 4/2006 |
| WO | 06/65192 | A1 | 6/2006 |
| WO | 2006090290 | A1 | 8/2006 |
| WO | 2006105173 | A2 | 10/2006 |
| WO | 2006/120570 | A2 | 11/2006 |
| WO | 2006/127772 | A2 | 11/2006 |
| WO | 07/37962 | A1 | 4/2007 |
| WO | 2007057789 | A2 | 5/2007 |
| WO | 2007057791 | A2 | 5/2007 |
| WO | 2007082599 | A1 | 7/2007 |
| WO | 2007104573 | A2 | 9/2007 |
| WO | 2007/126361 | A1 | 11/2007 |
| WO | 08/16520 | A2 | 2/2008 |
| WO | 2008042331 | A2 | 4/2008 |
| WO | 2008104891 | A2 | 9/2008 |
| WO | 2008140372 | A1 | 11/2008 |

OTHER PUBLICATIONS

International Search Report and Written Opinion dated Mar. 25, 2009 for PCT/IB2008/002682.

Partial International Search Report dated Oct. 6, 2006 for PCT/IB2006/001611.

International Search Report and Written Opinion dated Feb. 27, 2007 for PCT/IB2006/002680.

International Preliminary Report on Patentability dated Oct. 30, 2007 for PCT/IB2006/001611.

International Preliminary Report on Patentability dated Dec. 16, 2008 for PCT/IB2006/002680.

International Search Report and Written Opinion dated Aug. 6, 2007 for PCT/IB2006/004077.

International Search Report and Written Opinion dated Sep. 12, 2008 for PCT/IB2008/001378.

International Search Report and Written Opinion dated Mar. 24, 2009 for PCT/IB2008/002764.

International Preliminary Report on Patentability dated Jan. 19, 2010 for PCT/IB2008/002764.

International Search Report and Written Opinion dated Jul. 17, 2009 for PCT/IB2008/002714.

International Preliminary Report on Patentability dated Jan. 19, 2010 for PCT/IB2008/002714.

International Search Report and Written Opinion dated Jan. 30, 2009 for PCT/IB2008/002598.

International Search Report and Written Opinion dated Feb. 25, 2009 for PCT/IB2008/002566.

International Preliminary Report on Patentability dated Dec. 11, 2009 for PCT/IB2008/002598.

International Search Report and Written Opinion dated Mar. 31, 2009 for PCT/IB2008/002681.

International Search Report and Written Opinion dated Jul. 25, 2006 for PCT/IB2006/001114.

International Preliminary Report on Patentability dated Aug. 28, 2007 for PCT/IB2006/001114.

International Search Report and Written Opinion dated Mar. 13, 2009 for PCT/IB2008/002694.

International Preliminary Report on Patentability dated Jan. 19, 2010 for PCT/IB2008/002694.

Satel, Sally M.D., "A Smokeless Alternative to Quitting," Apr. 6, 2004, The New York Times, Accessed Oct. 25, 2010; http://query.nytimes.com/gst/fullpage.html?res=9402EFD91E39F935A35757C0A9-629C8B63.

International Preliminary Report on Patentability issued Jan. 19, 2010 for PCT/IB2008/002682.

International Search Report and Written Opinion mailed Mar. 25, 2009 for PCT/IB2008/002682.

Utility U.S. Appl. No. 12/219,118, filed Jul. 16, 2008.

Utility U.S. Appl. No. 12/155,633, filed Jun. 6, 2008.

Utility U.S. Appl. No. 12/155,635, filed Jun. 6, 2008.

Utility U.S. Appl. No. 12/219,114, filed Jul. 16, 2008.

International Preliminary Report on Patentability mailed Dec. 16, 2008 for PCT/IB2006/002680.

International Search Report and Written Opinion mailed Mar. 24, 2009 for PCT/IB2008/002764.

International Preliminary Report on Patentability issued Jan. 19, 2010 for PCT/IB2008/002764.

International Search Report and Written Opinion mailed Jul. 17, 2009 for PCT/IB2008/002714.

International Preliminary Report on Patentability issued Jan. 19, 2010 for PCT/IB2008/002714.

International Search Report and Written Opinion mailed Feb. 25, 2009 for PCT/IB2008/002566.

International Preliminary Report on Patentability issued Dec. 11, 2009 for PCT/IB2008/002598.

International Search Report and Written Opinion mailed Mar. 31, 2009 for PCT/IB2008/002681.

International Search Report and Written Opinion mailed Jul. 25, 2006 for PCT/IB2006/001114.

U.S. Appl. No. 12/789,125, filed May 27, 2010.

U.S. Appl. No. 12/748,205, filed Mar. 26, 2010.

International Search Report and Written Opinion mailed Mar. 13, 2009 for PCT/IB2008/002694.

International Preliminary Report on Patentability issued Jan. 19, 2010 for PCT/IB2008/002694.

ORAL POUCH PRODUCT HAVING SOFT EDGE AND METHOD OF MAKING

CROSS REFERENCE TO RELATED APPLICATION

This application is a U.S. continuation patent application of U.S. application Ser. No. 18/064,477, filed Dec. 12, 2022, which is a U.S. continuation patent application of U.S. application Ser. No. 16/851,797, filed Apr. 17, 2020, which is a U.S. continuation patent application of U.S. application Ser. No. 15/869,193, filed Jan. 12, 2018, which is a U.S. continuation patent application of U.S. application Ser. No. 14/594,664, filed Jan. 12, 2015, which is a U.S. divisional patent application of U.S. application Ser. No. 12/219,113, filed Jul. 16, 2008, now U.S. Pat. No. 8,950,408, issued Feb. 10, 2015, entitled ORAL POUCH PRODUCT HAVING SOFT EDGE AND METHOD OF MAKING which claims priority under 35 U.S.C. § 119 (e) to U.S. Provisional Application No. 60/929,876, filed Jul. 16, 2007, the entire contents of each of which is incorporated herein by reference.

SUMMARY

An oral pouch product includes a paper, plastic or fabric pouch wrapper having a soft edge. The pouch encloses tobacco fibers, botanical fibers, capsules, beads, powders, granules, extracts and/or other food grade materials. The enclosed material provides flavor as the user sucks, chews, and/or manipulates the pouch, saliva mixes with the enclosed materials, and the flavors leach out of the pouch through pores. The enclosed material is contained within the pouch wrapper by a seam such as a heat or adhesive seal located inwardly of the outer periphery of the pouch to provide a soft edge.

DETAILED DESCRIPTION

Figure 1:
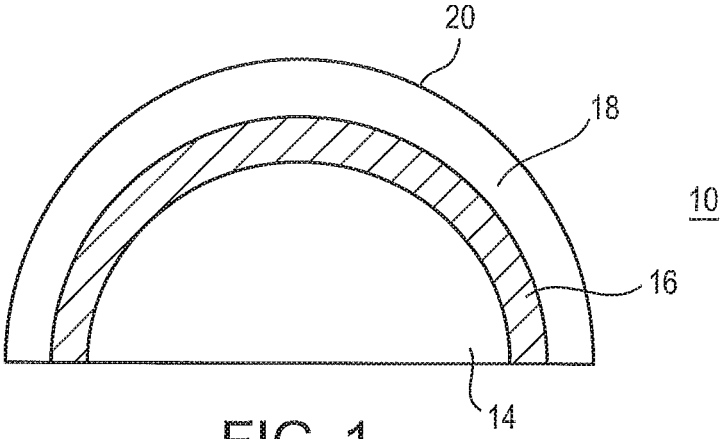
FIG. 1 is an illustration of an oral pouch product having soft edges.

As described herein, an oral pouch product 10, shown in FIG. 1, can include a filling which provides an engaging, flavorful, aromatic, energizing, and/or soothing experience by delivering ingredients to a user in a consumable unit. Preferably, the oral pouch product 10 can be sucked, chewed and/or orally manipulated when placed in a user's mouth to release flavorants contained therein.

In a preferred embodiment, the oral pouch product 10 includes a porous pouch wrapper 14 enclosing an inner filling material 12 (shown in FIG. 2), and sized to fit comfortably in the mouth. At least one seam 16 closes an opening of the pouch, which contains inner filling material 12 within the porous pouch wrapper 14. Preferably, the seam 16 does not extend to the free edges 20 of the porous pouch wrapper 14 so as to leave a soft, unbonded area 18 which increases comfort of sensitive mouth tissue.

Figure 2:
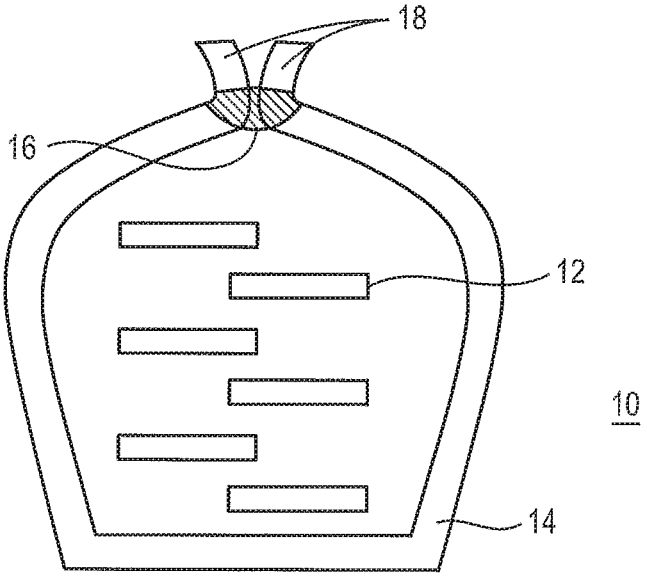
FIG. 2 is a cross-sectional view of the oral pouch product of FIG. 1.

As best seen in FIGS. 1 and 2, the oral pouch product 10 includes an inner filling material 12 contained in a porous pouch wrapper 14 that has a seam 16 along an edge of the porous pouch wrapper 14. The at least one seam 16 does not extend to the free edges 20 of the porous pouch wrapper 14 so that a soft edge 18 remains for comfort of the user.

Figure 3:
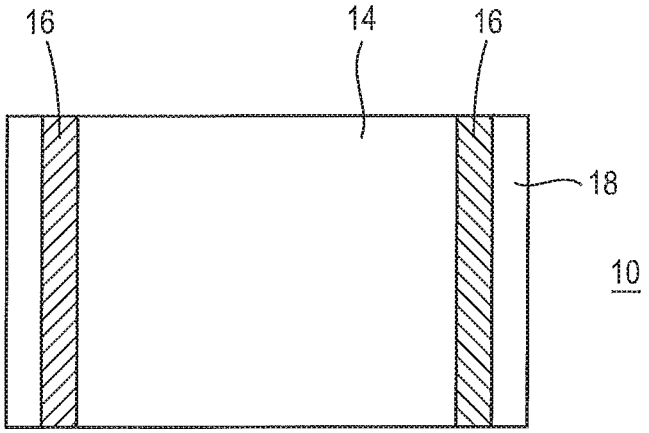
FIG. 3 is an illustration of an oral pouch product having two soft edges.

Referring now to FIG. 3, in an embodiment, the oral pouch product 10 includes multiple seams 16 for retaining the inner filling material in the porous pouch wrapper 14.

In a preferred embodiment, the at least one seam 16 can be formed by heat sealing. Alternatively, the seam 16 can be formed using a food grade adhesive. Preferably, the seam 16 is about 1.0 mm to about 4.0 mm in width.

Figure 4:
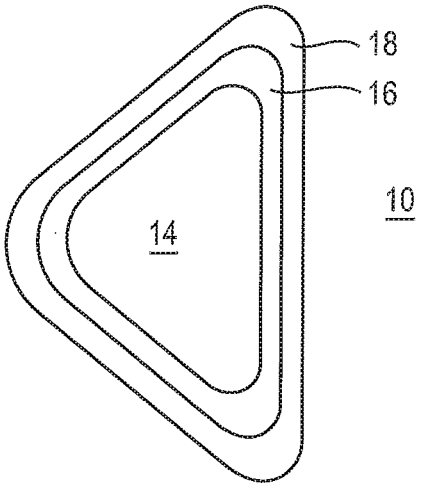
FIG. 4 shows a D-shaped pouch having a seam around the entire periphery thereof.

In a preferred embodiment, the seam 16 does not extend to the edges 20 of the pouch wrapper 14 so that a soft edge 18 remains at the edge of the pouch wrapper 14. In a preferred embodiment, the soft edge 18 is formed by an unbonded area extending about 0.1 mm to about 1.5 mm in width. In one embodiment, the soft edge 18 can extend around the entire perimeter of the oral pouch product 10, as shown in FIG. 4. In another embodiment, the soft edge 18 extends partially around the perimeter of the oral pouch product, e.g., the seam can extend along free edges of a folded over piece of wrapper material. When the oral pouch product 10 is placed in the mouth, the soft edge 18 is comfortable to the user.

FIG. 4 shows a D-shaped pouch 10 having rounded corners and a seam 16 around the entire periphery thereof. The dimensions of the pouch are about 0.25 inch in thickness, about 0.75 inch in length and about 0.5 inch in width with the inner filling located inwardly of the inner periphery of seam 16. The inner periphery of seam 16 is separated from the outer edge of the pouch by an unbonded area 18 which extends about 0.1 inch inside the outer periphery of the pouch.

In a preferred embodiment, the inner filling material 12 includes botanical fibers, powders, extracts, capsules, microcapsules, beads, granules, liquids, semi-liquids, gels, and other food grade materials. The inner filling material 12 can form a matrix that is held together as a pliable mass by a binder. Preferably, the inner filling material 12 is a tobacco containing or tobacco-free filling which includes sweeteners, flavorants, coloring agents, functional ingredients, and the like. The inner filling material 12 can be loose or solid.

In a preferred embodiment, the binder is a food grade adhesive, gum or other binder. Suitable binders include, without limitation, sodium alginate, sugar, agar, guar gum, and the like. In a preferred embodiment, the binder is added in an effective amount such as about 10% to about 60% by weight of the oral product.

In a preferred embodiment, capsules, microcapsules, and/or beads of various sizes can be included in the oral pouch product 10. Also preferably, about 2 to about 40 capsules, microcapsules, and/or beads are included in the oral pouch product 10, depending on the size of the final product and the size of the capsules, microcapsules, and/or beads. Preferably, the capsules, microcapsules, and/or beads range in size from about 0.1 mm to about 8 mm depending on the ingredients contained therein.

In an embodiment, the capsules, microcapsules, and/or beads have shells of varying thicknesses. Varying the thicknesses of the shells of the capsules, microcapsules, and/or beads included in the oral pouch product 10 allows for the ingredients contained in each capsules, microcapsules, and/or beads to be released at varying rates so as to prolong the flavor and/or functional experience. Preferably, the shells range in thickness from about 0.1 mm to about 7 mm, depending on the size of the capsules, microcapsules, and/or beads and the preferred dissolution rate. Preferably, the capsules, microcapsules, and/or beads having the thinnest shells dissolve first to release the enclosed flavors and functional ingredients. Capsules, microcapsules, and/or beads having thicker shells dissolve at a slower rate to provide continued flavor and functional ingredients.

In a preferred embodiment, the ingredients of the capsules, microcapsules, and/or beads are released by mastication, sucking, moisture, pH change, and the like. Each of the capsules, microcapsules, and/or beads included in the oral pouch product 10 may have the same or a different release mechanism to aid in varying the release rate of the capsules, microcapsules, and/or beads.

In a preferred embodiment, the inner filling material can include functional ingredients such as, without limitation, chemesthesis agents, antioxidants, vitamins, soothing agents, energizing agents and the like. In a preferred embodiment, the soothing agents include, without limitation, chamomile, lavender, jasmine, and the like. Preferably, the energizing ingredients or vitamins include, without limitation, caffeine, taurine, guarana, vitamin B6, vitamin B12, and the like. Suitable chemesthesis ingredients provide, without limitation, hot, spicy, or cooling flavors such as mint, menthol, cinnamon, pepper, and the like.

Preferably, the porous pouch includes one or more flavorants. The flavorants can be added in the form of a liner or coating applied to the pouch wrapper. Suitable flavorants include berry flavors such as, without limitation, pomegranate, acai, raspberry, blueberry, strawberry, and/or cranberry. Other suitable flavors include, without limitation, any natural or synthetic flavor or aroma, such as menthol, peppermint, spearmint, bourbon, scotch, whiskey, cognac, hydrangea, lavender, chocolate, licorice, citrus and other fruit flavors, such as apple, peach, pear, cherry, plum, orange and grapefruit, gamma octalactone, vanillin, ethyl vanillin, breath freshener flavors, spice flavors such as cinnamon, clove, nutmeg, sage, anise, and fennel, methyl salicylate, linalool, jasmine, coffee, bergamot oil, geranium oil, lemon oil, and ginger oil.

In a preferred embodiment, the inner filling material 12 can also include non-tobacco botanical components such as tea and tea extracts, coffee, coffee extracts, vegetables, vegetable extracts, and/or herbs and herb extracts.

In a preferred embodiment, the inner filling material 12 can include a powdered component to provide an additional layer of texture and/or flavor. Preferably, the powdered component is selected from, without limitation, dry sour cream, powdered sugar, powdered cocoa, powdered spices, and/or powdered herbs and other botanicals such as tea and/or tea extracts.

In another embodiment, the inner filling material 12 can include a viscous substance. In a preferred embodiment, the viscous substance is selected from substances such as honey, molasses, syrups, and the like.

In an embodiment wherein the inner filling material 12 includes natural or artificial sweeteners, preferred sweeteners include, without limitation, water soluble sweeteners such as monosaccharides, disaccharides, and polysaccharides such as xylose, ribose, sucrose, maltose, fructose, glucose, and mannose. In an embodiment, sugar alcohols such as xylitol, mannitol, sorbitol and maltitol can be included. Non-nutritive artificial sweeteners, such as sucralose can also be used.

In a preferred embodiment, the inner filling material 12 completely fills the interior of the pouch wrapper 14. In another embodiment, the inner filling material 12 partially fills the interior of the pouch wrapper 14.

Preferably, the oral pouch product 10 is sized and configured to fit comfortably in a user's mouth. Preferably, the oral pouch product 10 delivers a plurality of flavor and/or functional ingredients to the user for a period of about one minute to about 1 hour. Preferably, the pouch 10 is discarded after a single use.

In an embodiment, the oral pouch product 10 has maximum dimensions of about 0.1 inches to about 2.0 inches. In an embodiment, the oral pouch product 10 weighs between about 0.2 g and 5.0 g. The weight is predominately based on the weight of the enclosed inner filling material 12.

Preferred pouch shapes include, without limitation, a half moon, D-shape, sphere, rectangle, square, oval, pouch-shape, crescent, rod-shape, oblong, cylindrical, tea leaf, tear drop, or hourglass shapes. In an embodiment, the pouch-shape is similar to a ravioli or pillow shape. Other shapes may be utilized so long as the shapes are comfortable and fit discreetly in a user's mouth. In an embodiment, the shape of the pouch is indicative of the flavor. Thus, the pouch may be shaped as fruits, vegetables, or other objects. For instance, the pouch could be in the shape of a banana to indicate a banana flavor.

In a preferred embodiment, the wrapper 14 of the oral pouch product 10 is made of a porous material optionally including a flavored or non-flavored dissolvable coating. The coating can provide an initial flavor burst upon placement of the pouch in an oral cavity. In addition, the coating can include functional or salivation inducing ingredients. Preferably, the porous material allows the flavors and functional ingredients contained in the inner filling material 12 to diffuse out of the pouch wrapper 14 and into the user's mouth. Preferred porous materials include, but are not limited to, films, gelatin, food casings, carrageenan, biopolymers, fabric and/or paper such as filter paper, papers used to construct tea bags, coffee filters, and the like. Preferably, the pouch wrapper 12 is of the type suitable for contact with food, such as materials used for packaging and/or handling foods.

Also provided is a method of making an oral pouch product having a soft edge. The method includes forming a wrapper into an open pouch using a vertical or horizontal fill machine and filling the open pouch with an inner filling material. The pouch is then sealed to contain the inner filling material and form an oral pouch product. Preferably, a series of pouches are formed with a space between seals of adjacent pouches and then cut apart to form individual pouch products. For instance, the pouch product may be cut with a die at a location between adjacent seals so as to form a soft edge on each pouch product. In an alternative embodiment, the seal can be formed at a distance from the edge of the wrapper material when the wrapper material being used is previously cut to size.

Alternatively, a first strip of pouch wrapper material can be advanced along a feed path, filling material in matrix form can be placed on the strip, a second strip can be placed over the first strip, a sealing die can be used to press the strips together and form a seam such as a heat seal or adhesive seal around the filling, and a cutting die can be used to cut the first and second strips outwardly of the seam to form the soft edge.

While the foregoing has been described in detail with reference to specific embodiments thereof, it will be apparent to one skilled in the art that various changes and modifications may be made, and equivalents thereof employed, without departing from the scope of the claims.

We claim:

1. An oral pouch product comprising:

a porous pouch wrapper defining an enclosure therein, the porous pouch wrapper including, at least one seam, and an unbonded area outward of the at least one seam, the unbonded area extending at least partially about a perimeter of the oral pouch product; and an inner filling material within the enclosure, wherein the unbonded area has a width of 0.1 mm to about 1.5 mm from the at least one seam to an unbonded edge.

2. The oral pouch product of claim 1, wherein the at least one seam is about 1.5 mm to about 4.0 mm in width.

3. The oral pouch product of claim 1, wherein the at least one seam is a heat seal.

4. The oral pouch product of claim 1, wherein the at least one seam is an adhesive seal.

5. The oral pouch product of claim 1, wherein the inner filling material comprises tobacco.

6. The oral pouch product of claim 1, wherein the inner filling material is tobacco-free.

7. The oral pouch product of claim 1, wherein the inner filling material includes capsules, microcapsules, beads, or any combination thereof.

8. The oral pouch product of claim 1, wherein the inner filling material includes a non-tobacco botanical material.

9. The oral pouch product of claim 1, wherein the oral pouch product weighs about 0.1 gram to 5.0 grams.

10. The oral pouch product of claim 1, wherein the oral pouch product has a length of about 0.75 inch, a width of about 0.5 inch, and a thickness of about 0.25 inch.

11. The oral pouch product of claim 1, wherein the oral pouch product is D-shaped.

12. The oral pouch product of claim 1, further comprising: a liner on the porous pouch wrapper.

13. The oral pouch product of claim 12, wherein the liner includes at least one flavorant.

14. The oral pouch product of claim 1, further comprising: a coating on the porous pouch wrapper.

15. The oral pouch product of claim 14, wherein the coating includes at least one flavorant.

16. The oral pouch product of claim 1, wherein the inner filling material includes an energizing ingredient.

17. The oral pouch product of claim 16, wherein the energizing ingredient includes caffeine, taurine, guarana, vitamin B6, vitamin B12, or any combination thereof.

18. The oral pouch product of claim 1, wherein the inner filling material includes a botanical material, a binder, a sweetener, and a flavorant.

19. The oral pouch product of claim 18, wherein the inner filling material is in loose or solid form.

* * * * *